US007381168B2

(12) United States Patent
Bowser

(10) Patent No.: US 7,381,168 B2
(45) Date of Patent: Jun. 3, 2008

(54) EXERCISE SYSTEM USING EXERCISE RESISTANCE CABLES

(76) Inventor: John Bowser, 1275 Pacific Ave., Laguna Beach, CA (US) 92651

( * ) Notice: Subject to any disclaimer, the term of this patent is extended or adjusted under 35 U.S.C. 154(b) by 145 days.

(21) Appl. No.: 10/783,532

(22) Filed: Feb. 21, 2004

(65) Prior Publication Data

US 2005/0187080 A1 Aug. 25, 2005

(51) Int. Cl.
*A63B 21/00* (2006.01)

(52) U.S. Cl. ..... 482/121; 482/130; 482/142

(58) Field of Classification Search ..... 482/121–130, 482/148, 142, 100, 52, 140; 24/114.5, 129, 24/128

See application file for complete search history.

(56) References Cited

U.S. PATENT DOCUMENTS

| | | | | | |
|---|---|---|---|---|---|
| 704,840 | A | | 7/1902 | Korth | |
| 1,279,120 | A | | 9/1918 | Kellogg | |
| 3,606,321 | A | | 9/1971 | Macoulis | |
| 3,677,543 | A | | 7/1972 | Richardson | |
| 3,738,649 | A | | 6/1973 | Miller | |
| 3,843,119 | A | | 10/1974 | Davis | |
| 4,019,734 | A | | 4/1977 | Lee | |
| 4,251,071 | A | | 2/1981 | Norton | |
| 4,720,099 | A | | 1/1988 | Carlson | |
| 4,733,862 | A | | 3/1988 | Miller | |
| 4,788,754 | A | * | 12/1988 | Fukumoto | 24/114.5 |
| 4,838,547 | A | | 6/1989 | Sterling | |
| 4,852,874 | A | | 8/1989 | Sleichter, III | |
| 4,913,423 | A | | 4/1990 | Farran | |
| 4,921,247 | A | | 5/1990 | Sterling | |
| 5,044,633 | A | | 9/1991 | Rice | |
| 5,080,353 | A | | 1/1992 | Tench | |
| 5,112,287 | A | * | 5/1992 | Brewer | 482/130 |
| 5,387,171 | A | | 2/1995 | Casey | |
| 5,417,643 | A | | 5/1995 | Taylor | |
| 5,470,298 | A | | 11/1995 | Curtis | |
| 5,779,601 | A | * | 7/1998 | Ish, III | 482/100 |
| 5,899,836 | A | * | 5/1999 | Chen | 482/92 |
| 6,500,104 | B1 | * | 12/2002 | Rich | 482/123 |
| 6,508,749 | B1 | | 1/2003 | Broadwater | |
| 6,544,152 | B2 | * | 4/2003 | Rosati | 482/126 |
| 6,908,417 | B2 | * | 6/2005 | Jackson | 482/52 |
| 2002/0077228 | A1 | | 6/2002 | McBride | |
| 2002/0173412 | A1 | | 11/2002 | Stearns | |

* cited by examiner

*Primary Examiner*—Jerome Donnelly
(74) *Attorney, Agent, or Firm*—Lawrence N. Ginsberg

(57) ABSTRACT

An exercise resistance cable apparatus for engagement with an activity bay of a support structure. The exercise resistance cable apparatus includes a plurality of serially connected cable/anchor modules. A first of the cable/anchor modules includes a first elastic exercise resistance cable; and, a first cable expansion anchor securely connected to a first end of the elastic exercise resistance cable. Subsequent cable/anchor modules include associated exercise resistance cables and cable expansion anchors. A hand grip is connected to a second end of the first elastic exercise resistance cable. The exercise resistance cable apparatus is particularly adapted to be used with an exercise chair having a frame with a plurality of activity bays positioned at desired locations thereon. The activity bays have slots formed therein that are disposed at the desired orientations for engagement with a cable expansion anchor of an exercise resistance cable apparatus.

8 Claims, 4 Drawing Sheets

EXERCISE SYSTEM USING EXERCISE RESISTANCE CABLES

BACKGROUND OF THE INVENTION

1. Field of the Invention

The present invention relates to exercise devices and systems and more particularly to an exercise system that utilizes removable exercise resistance cables that connect to activity bays of a support structure.

2. Description of the Related Art

The use of resistance cables for exercising is well known in the prior art. There are a multitude of different exercise systems and devices that have been previously disclosed or are currently in the market to supply the increasing demand for physical fitness. Many of these utilize resistance cables. For example, as far back as 1902, U.S. Pat. No. 704,840, issued to J. C. Korth et disclosed the use of an exercising machine employing elastic cords. U.S. Pat. No. 3,606,321, issued to N. D. Macoulis, discloses the use of elastic cords and a pole. U.S. Pat. No. 3,843,119, issued to R. P. Davis, discloses the use of a machine for exercising the arm muscles while the user stands upon a base.

U.S. Pat. No. 4,019,734, issued to W. Lee et al discloses an elastic resistance type exercising device having a single length of latex rubber surgical tubing whose two ends are formed into size handle loops by the use of leather fasteners. The handle loops are sleeved with vinyl tubing, and plugs are inserted in each of the open ends of tubing, that have twice passed through the fasteners to form the loops, to prevent the tubing from being pulled out of the fasteners. A user grasps the handle loops or secures them about his ankles and pulls against the elastic resistance. Two additional flexible sleeves are slidably mounted over the portion of the elastic tubing between the fasteners.

U.S. Pat. No. 3,677,543, issued to J. H. Richardson, discloses a pull type exercising device including a single piece of elastic tubing with loops formed at the respective ends of the tubing by s-shaped hooks that receive folded ends of the tubing. On each looped portion there is a sleeve. A slideable ring with an anchoring attachment is mounted on a tubular member. A user inserts an arm or leg in the loops and pulls his arm or leg and pulls on the anchored tubular member.

U.S. Pat. No. 6,508,749, issued to R. L. Broadwater, discloses a portable exercise device that includes an elastic cord with two ends. Each of the ends of the cord is received into opposite sides of a coupling. A clamp element is provided around a portion of the coupling. The clamp element compresses the coupling around the elastic cord to hold the cord in place inside the coupling. A handle may be provided around the coupling. The handle may be made from a resilient material so that the hand of the user may squeeze it. Additionally, end plugs may be provided for the handle to prevent the handle from slipping off the coupling.

U.S. Pat. No. 4,251,071, issued to Craig D. Norton, discloses an exercising device that comprises an elongated elastic cord with a foot-receiving loop formed at each end and a hollow hand grip with an axial bore extending from end to end with a longitudinally extending split permitting one or two lengths of the elastic rope to be inserted into the bore. The hand grip may be squeezed by the hand for causing the wall of the bore to frictionally grip the rope. The hand muscles are exercised by this squeezing action on the hand grip and the arm and shoulder muscles are exercised when the hand grip pulls on the rope to elongate it.

U.S. Pat. No. 4,852,874, issued to C. G. Sleichter, III et al, disclose an exercise device that includes an elastic loop having free ends spliced together, generally tubular handles disposed in diametrically opposed relation to one another on the loop and an elastic retainer sleeve surrounding intermediate portions of the loop between the handles. The device is conformable for use in performing a wide variety of exercises and for performing a selected number of repetitions of each exercise by grasping the handles and stretching against the resistance load of the loop and the retainer means. The handles can be grasped either by the hands or by a combination of hands and feet to perform various exercises or may be grasped between the feet or ankle portions to perform other exercises. In modified forms of the invention, one of the handles is made rigid so as to simulate a racquet or golf club handle to be used in practicing forehand and backhand strokes or to simulate the golf swing. The exercises may be performed effectively in either the standing, sitting or fully prone position. Other modified forms of invention include an anchor strap to facilitate practicing of the golf swing and a splice for joining together free ends of the loop into a unitary member.

U.S. Pat. No. 4,733,862, issued to J. V. Miller discloses an elastic resistance exerciser comprising an elongated elastic member having a loop formed at each end, a tubular handle slidably fit onto each loop of the elastic member, and a self-locking slider having three holes; with the elastic member slidably threaded through two of the holes and terminating the end of each loop in the third hole of each slider; the slider being adjustable along the elastic member, whereby the size of the loop may be varied by moving the slider with no tension on the loop, but self-locking by the application of tension to the loop. A preferred embodiment provides a band of flexible material attached approximately to the center of the length of an elastic member having more than one elastic element.

The above-mentioned patents each use elastic cable which functions as a resistance tool for exercising the body. In some cases the elastic/rubber cable is the only thing necessary to achieve the complete workout. In other cases a secondary product, such as a door, a handle or some sort of stationary device is required in order to use the product as designed.

There are a variety of patents that disclose exercise systems related to chairs. For example, U.S. Pat. No. 5,470,298, issued to J. L. Curtis; U.S. Pat. No. 5,417,643, issued to M. D. Taylor; U.S. Pat. No. 5,387,171, issued to M. E. Casey; U.S. Pat. No. 5,080,353, issued to L. Teach; U.S. Pat. No. 5,044,633, issued to B. A. Rice; U.S. Pat. No. 4,921,247, issued to J. F. Sterling; U.S. Pat. No. 4,838,547, issued to J. F. Sterling; U.S. Pat. No. 4,720,099, issued to R. B. Carlson; U.S. Pat. No. 1,279,120, issued to J. H. Kellogg; U.S. Publicn No. 2002/0173412 to K. W. Stearns; and, U.S. Publicn No. 2002/0077228 to R. W. McBride each disclose chair-related related exercise devices which have generally complicated designs.

U.S. Pat. No. 4,913,423, issued to M. R. Farran, discloses a furniture article, such as a seating article, for residential and office use that includes a frame housing, one or more exercise apparatus that are located in the armrest, the back and the seating base. The frame is selectively covered to provide the seating article with the appearance of a conventional furniture article used in the home or office. Each exercise apparatus employs a cable extending through the covering to communicate a source of resistive force from within the frame to a user outside of the frame. On the end of the cable outside of the covering is a handle or a foot stirrup by which the user pulls the cable out of the seating article. A cover conceals the handle or foot stirrup as well as the end of the cable while the exercise aspects of the furniture article are not being utilized. As in the other patents, discussed above, the Farran system is somewhat complicated. Furthermore, it is non-mobile and is limited in the amount of workout routines allotted.

With the increasing population of elderly persons and their desire for increased exercise there is a concomitant growing need for exercise equipment that the elderly can easily and efficiently use. As will be disclosed below, the present invention satisfies these needs.

SUMMARY OF THE INVENTION

In a broad aspect, the present invention is an exercise resistance cable apparatus for engagement with an activity bay of a support structure. The exercise resistance cable apparatus includes a plurality of serially connected cable/anchor modules. A first of the cable/anchor modules includes a first elastic exercise resistance cable; and, a first cable expansion anchor securely connected to a first end of the elastic exercise resistance cable. Subsequent cable/anchor modules include associated exercise resistance cables and cable expansion anchors. A hand grip is connected to a second end of the first elastic exercise resistance cable.

Preferably, each cable expansion anchor is spool-shaped—including a shaft, a first radially extending flange on the shaft; and, a second radially extending flange on the shaft, the second radially extending flange being longitudinally spaced from the first flange.

The exercise resistance cable apparatus is particularly adapted to be used with an exercise chair having a frame with a plurality of activity bays positioned at desired locations thereon. The activity bays are each preferably formed with L-shaped slots. The slots are disposed at the desired orientations for engagement with a cable expansion anchor of an exercise resistance cable apparatus.

This system is particularly advantageous for use with elderly persons. It is easy to use, particularly for the elderly, because, assuming that the chairs are set up, the person merely picks up the desired cables and brings those cables to his or her workout station, attaches the cable(s) and is ready to work out.

Foldable chairs may be utilized that can be stored or kept in a variety of places such as in the home, hotels, retirement communities, health clubs, and physical therapy centers. Use of such foldable chairs provides a very mobile environment.

The present exercise system provides strength training without the stress of a pre-designed rigid machine. A person can take a cable, connect the anchor and exercise in accordance with his body height and size.

The chair may be integrated into a universal gym system and utilized with a variety of exercises.

Use of the present invention has several advantages over the prior art. It allows the user to easily change resistance levels and adjust resistant lengths—all from a seated position. The present inventive concepts provide safe, low impact exercise solutions that are easy to use and make the user feel better. The folding resistance chair provides a very convenient home exercise system. The chair allows the user to perform a full body workout from a safe, comfortable seated position. When seated, balance and stability is maintained as the arms, chest, shoulders, abdomen, back, and legs are exercised. The present invention allows anchoring of the resistance cables at numerous points along the seat and backrest of the chair. This ensures that the cable remains at the best angle for each exercise. The unique cable system offers a wide range of upper body and lower body exercises and provides resistance without use of heavy weights. When utilizing the resistance cables with the resistance chair, the user is provided with a safe, comfortable, secure and well rounded exercise routine.

DETAILED DESCRIPTION OF THE INVENTION

Figure 1:
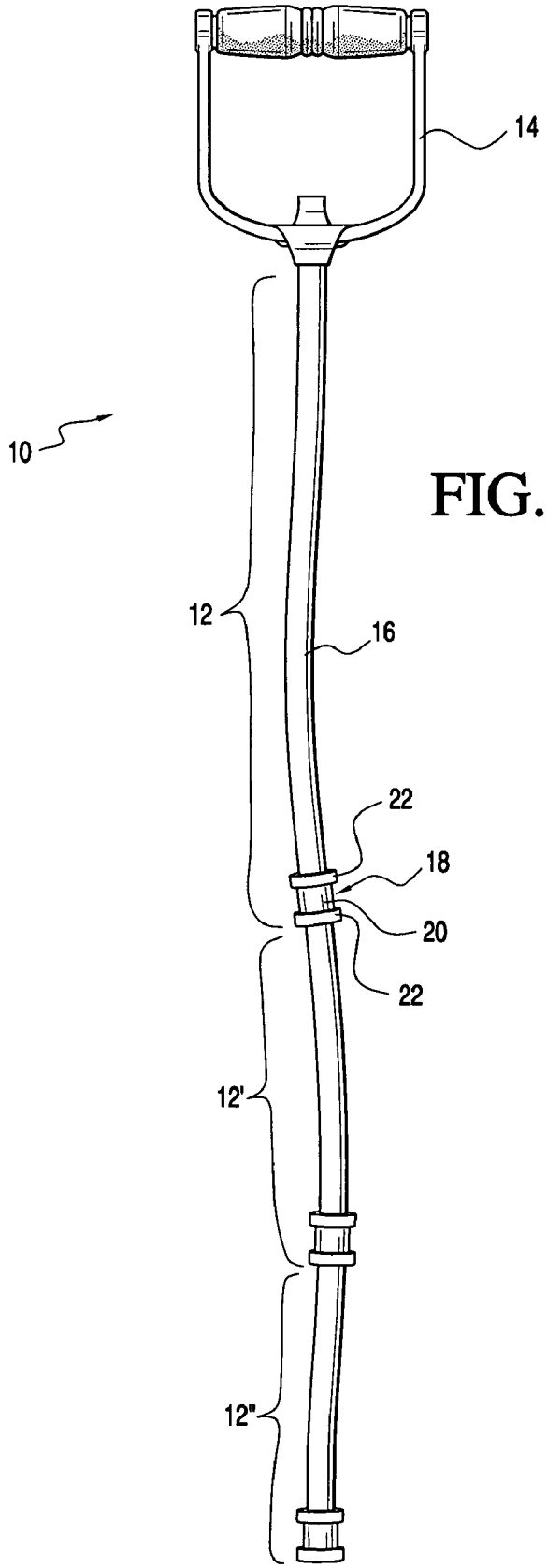
FIG. 1 is a perspective view of the exercise resistance cable apparatus of the present invention.

Referring now to the drawings and the characters of reference marked thereon, FIG. 1 illustrates a preferred embodiment of the exercise resistance cable apparatus of the present invention, designated generally as 10. The exercise resistance cable apparatus 10 includes a first cable/anchor module 12 and a handgrip 14. Additional cable/anchor modules 12', 12" are connected to the first cable/anchor module 12. The cable/anchor modules 12 are serially connected to provide a desired user length and resistance.

Each cable/anchor module 12 includes an elastic exercise resistance cable 16 which is connected at an end thereof to a cable expansion anchor 18. Each cable expansion anchor 18 is preferably spool-shaped and includes a shaft 20 and two longitudinally spaced radially extending flanges 22.

The additional cable/anchor modules 12', 12", . . . 12*n* are connected to provide the correct user length and resistance commensurate with the user's strength. Generally, the resistance is tied to the thickness or grade of materials used for the cable. Preferably, a varying degree of cables are implemented for use with this invention. They may be categorized, for example, in terms of light, medium and heavy resistance. Or, they may be more particularly be referred to relative to their resistance in pounds, i.e., Light—5 to 15 lbs of resistance, Medium—16 to 30 lbs of resistance. Heavy—31 to 45 lbs of resistance.

The elastic exercise resistance cables 16 are preferably formed of rubber; however, they may be formed of other suitable stretchable materials.

The cable expansion anchors 18 are preferably formed of hardened rubber; however, they may be formed of other resilient materials.

Figures 2, 3, 4:
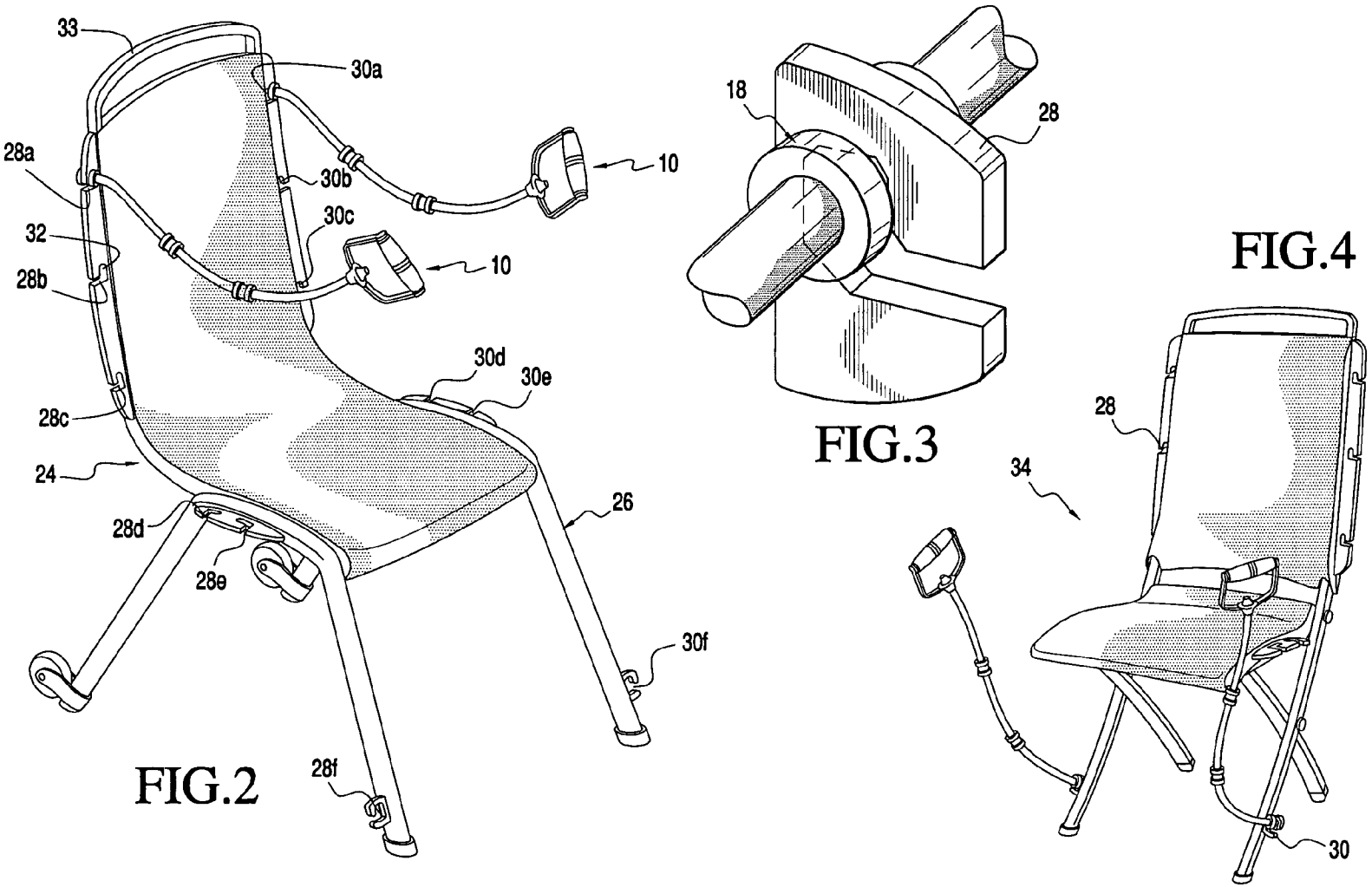
FIG. 2 is a perspective view of an exercise chair of the present invention with two exercise resistance cable apparatus' shown attached thereto.
FIG. 3 shows is an enlarged perspective view of a cable expansion anchor engaged with an activity bay of the support structure.
FIG. 4 is a perspective view of an alternate version of an exercise chair which is foldable.

Referring now to FIG. 2, the exercise resistance cable apparatus 10 is shown having been attached to an exercise chair, designated generally as 24. The chair 24 includes a chair frame 26 and a number of activity bays 28*a-f* and 30*a-f*. Each activity bay 28, 30 includes a slot 32 which is preferably L-shaped. The slots are positioned at desired locations on the chair frame 26 which are associated with designated exercises. The activity bays 28 are strategically placed on the resistance chairs to allow comfortable, ergonomically friendly and safe exercise routines. A shaft 20 of the chosen expansion anchor 18 is friction fitted within a desired slot 32. The slots 32 are oriented in the reverse direction of the applied pulling force for a designated exercise routine. Although FIG. 2 shows the resistance cables as projecting out horizontally, this is for the purpose of more clearly showing the features of the invention. The resistance cables are typically much more flaccid than as shown in this figure. (This is also the case with some of the illustrations of these cables in subsequent figures.)

Various exercise routines are available at the activity bays 28:

A. Activity bays 28*a*, 30*a:* i) Abdominal crunches—Stomach—Abdominal, Oblique.

iii) Triceps press—Arms—Triceps, Flexor Carpi Radials, Palmaris Longus iii) Decline Press—Chest—Pectoralis Major, Latissimus Dorsi iv) Chest Press—Chest—Pectoralis Major, Latissimus Dorsi B. Activity bays 28*b*, 30*b:* i) Chest Fly—Chest—Pectoralis Major, Latissimus Dorsi

C. Activity bays 28*c*, 30*c:* i) Incline Press—Chest—Pectoralis Major, Latissimus Dorsi

D. Activity bays 28*d*, 30*d:* i) Triceps Press—Arms—Triceps, Flexor Carpi Radials, Palmaris Longus ii) Overhead Press—Shoulders—Anterior Deltoid, Middle Deltoid, Triceps E. Activity bays 28*e*, 30*e:* i) Triceps Press—Arms—Triceps, Flexor Carpi Radials, Palmaris Longus ii) Overhead Press—Shoulders—Anterior Deltoid, Middle Deltoid, Triceps F. Activity bays 28*f*, 30*f:* i) Arm Curls—Arms—Biceps/Forearms-Extensor Digitorum, Brachioradialis ii) Upright Rows—Shoulders—Anterior Deltoid, Middle Deltoid iii) Lateral Raises—Shoulders—Anterior Deltoid, Middle Deltoid iv) Front Raises—Shoulders—Anterior Deltoid, Middle Deltoid v) Rear Delts—Back—Latissimus Dorsi, Teres Major, Rear Deltoid vi) Neck Rows—Back and Neck—Middle and Lower Trapezius, Platysma Still referring to FIG. 2, the top part of the seat back preferably includes a balance bar section 33. The balance bar section 33 provides the capability of performing the following exercises:

i) Squats—Legs—Gluteus Maximus, Satorius, Vastus Medialis, Vastus Lateralis, Rectus Femoris ii) Balancing—Body—Mental and muscular and body control iii) Stretching—Body—Range allows for stretching of various upper and lower muscle groups iv) Calf Raises—Gastrocnemius Muscle both Medial and Lateral heads Referring now to FIG. 3, a cable expansion anchor 18 is shown engaged with an activity bay 28 of a support structure. The cable expansion anchor 18 is securely friction fit within the activity bay 28 so as to allow minimal movement.

Referring now to FIG. 4 implementation of the principles of the present invention are shown with respect to a folding chair, designated generally as 34. As in the non-folding version, the folding chair 34 includes a plurality of activity bays 28, 30. Folding chairs 34 provide for convenient storage in a side-by-side manner while the non-folding embodiments 24 conveniently stack upon each other.

Figure 5:
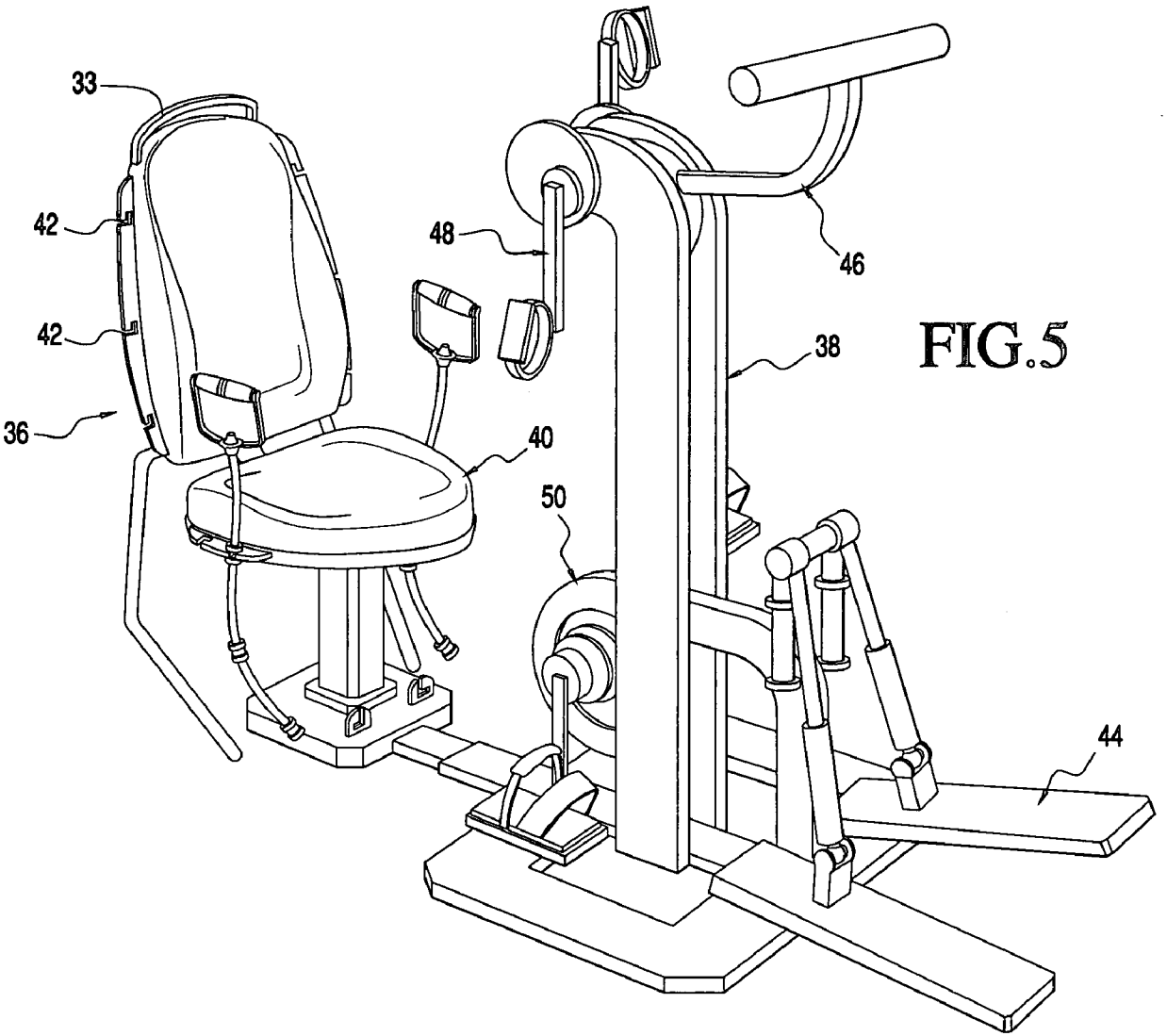
FIG. 5 perspective view of a universal exercise gym system in accordance with the principles of the present invention.

Referring now to FIG. 5, implementation of the principles of this invention is shown relative to a universal gym exercise system, designated generally as 36. This universal gym exercise system 36 includes a main frame, designated generally as 38, and a number of exercise components associated with the main frame. One of these components includes a support structure, i.e. exercise chair 40, having activity bays 42. Other components of the exercise system 36 may include a stepper assembly 44, a handle assembly 46, an ergometer 48, and a step rotator assembly 50. There is a wide variety of exercise equipment that can be connected to the frame 38, for example, a rowing machine or elliptical machine.

Figure 6:
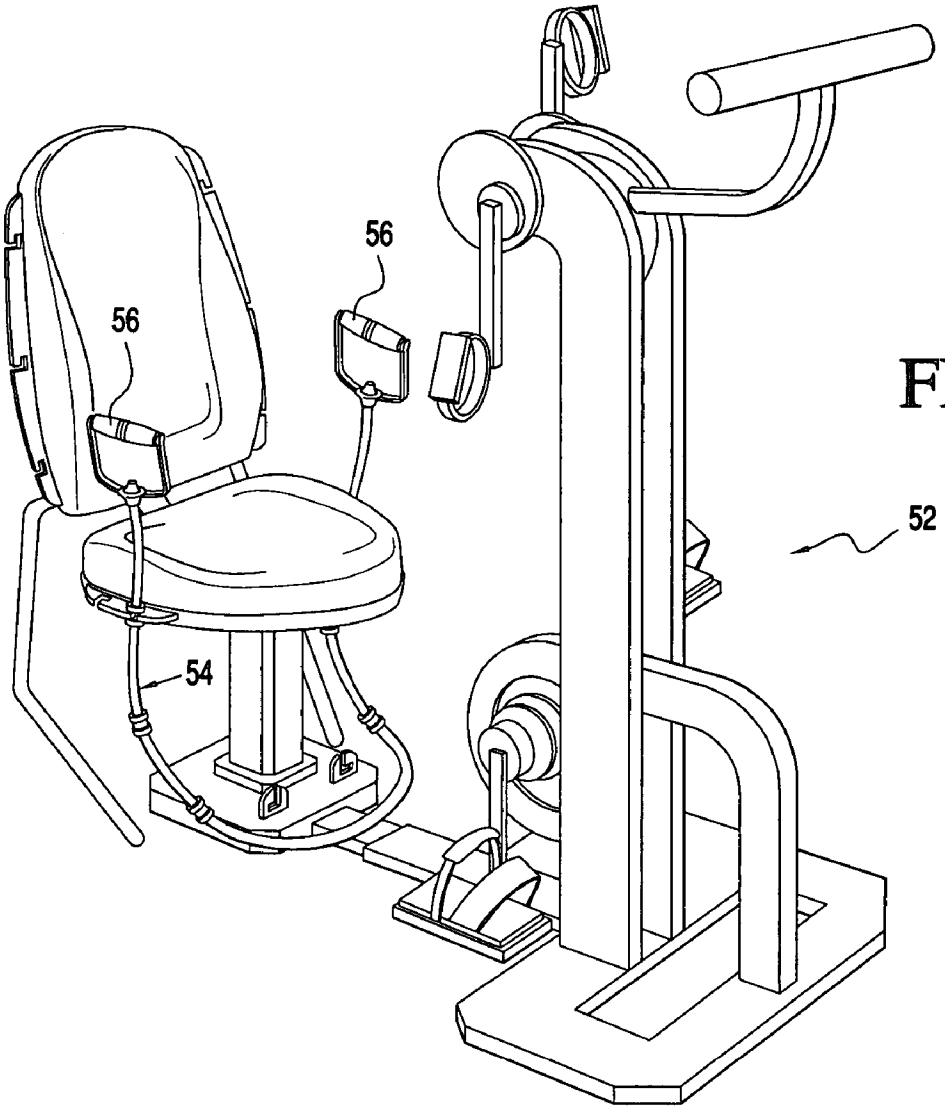
FIG. 6 is a perspective view of an alternate universal exercise gym system without a stepper assembly.

Referring now to FIG. 6, another embodiment of a universal gym is illustrated, designated generally as 52. Universal gym 52 is similar to that of FIG. 5; however, the stepper assembly 44 is omitted.

Although the present invention as thus far been described with reference to a exercise resistance cable apparatus having a handle at one end, FIG. 6 illustrates an alternate embodiment, designated generally as 54, in which the handles 56 are provided at both ends of the exercise resistance cable apparatus 54.

Obviously, many modifications and variations of the present invention are possible in light of the above teachings. It is, therefore, to be understood that within the scope of the appended claims, the invention may be practiced otherwise than as specifically described.

For example, although the invention has been described with a cable expansion anchor having a spool-shape other suitable shapes may be utilized. For example, a ball/socket system could be utilized. Further, the system may be embodied as a cable positioned in a storage unit wherein the cable would be pulled out of the storage unit to provide the desired length. Further, another system may be contemplated where the cable is locked into position with a locking element.

The invention claimed is:

1. An exercise system, comprising:

a) an exercise chair having activity bays secured thereto at shoulder height level on a chair frame and ankle height level on the chair frame, said activity bays each having a slot formed therein; and, b) at least one exercise resistance cable apparatus for engagement within said slot of said activity bay, comprising:

i. at least one cable/anchor module, comprising:

1. a first elastic exercise resistance cable; and, 2. a first cable expansion anchor securely connected, at a first end, to a first end of said elastic exercise resistance cable, comprising:

a. a shaft;

b. a first radially extending flange on said shaft; and, c. a second radially extending flange on said shaft, said second radially extending flange being longitudinally spaced from said first flange; and ii. a hand grip connected to a second end of said first elastic exercise resistance cable, wherein said shaft is engageable with said slot of said activity bay, relative movement therebetween being restricted by said first and second flanges.

2. The exercise system of claim 1 wherein said at least one cable/anchor module comprises a plurality of cable/anchor modules being serially connected to provide a desired user length and resistance.

3. The apparatus of claim 1 wherein each said cable expansion anchor is spool shaped.

4. An exercise system, comprising:

a) an exercise chair comprising a chair frame having a first side and a second side, said chair frame including four legs for support;

b) a plurality of activity bays secured to said chair frame, comprising:

i. a first activity bay positioned near an upper end of said first side of said chair frame at approximately shoulder height level at the seat back region of said chair frame;

ii. a second activity bay positioned near an upper end of said second side of said chair frame at approximately shoulder height level at the seat back region of said chair frame;

iii. a third activity bay positioned near a lower end of said first side of said chair frame at approximately ankle height level, at one of two front legs of said chair frame; and, iv. a fourth activity bay positioned near a lower end of said second side of said chair frame at approximately ankle height level, at a second of said two front legs of said chair frame; and, c) at least one exercise resistance cable apparatus for engagement with a selected one of said activity bays, comprising:

i. an elastic exercise resistance cable engageable with said selected one of said activity bays; and, ii. a hand grip connected to an end of said elastic exercise resistance cables wherein, said exercise resistance cable apparatus engages within a slot of an activity bay of said chair frame, said exercise resistance cable apparatus, comprising:

a) a first cable/anchor module, comprising:

i) said elastic exercise resistance cable; and, ii) a first cable expansion anchor securely connected, at a first end, to a first end of said elastic exercise resistance cable, comprising:

a. a shaft;

b. a first radially extending flange on said shaft; and, c. a second radially extending flange on said shaft, said second radially extending flange being longitudinally spaced from said first flange; and b) said hand grip connected to a second end of said first elastic exercise resistance cable, wherein said shaft is engageable with a slot of an activity bay, relative movement therebetween being restricted by said first and second flanges.

5. The system of claim 4 further comprising:

at least one additional cable/anchor module connected to said first cable/anchor module, said cable/anchor modules being serially connected to provide a desired user length and resistance.

6. The system of claim 5 wherein said at least one additional cable/anchor modules comprises two additional cable/anchor modules.

7. The system of claim 5 wherein said at least one additional cable/anchor modules comprises three additional cable/anchor modules.

8. The system of claim 4 wherein said cable expansion anchor is spool shaped.

* * * * *